US008391759B2

(12) United States Patent
Nakura

(10) Patent No.: US 8,391,759 B2
(45) Date of Patent: Mar. 5, 2013

(54) BELT DEVICE, BELT DEVIATION DETECTING DEVICE, AND IMAGE FORMING APPARATUS

(75) Inventor: Makoto Nakura, Ibaraki (JP)

(73) Assignee: Ricoh Company, Limited, Tokyo (JP)

( * ) Notice: Subject to any disclaimer, the term of this patent is extended or adjusted under 35 U.S.C. 154(b) by 806 days.

(21) Appl. No.: 12/076,813

(22) Filed: Mar. 24, 2008

(65) Prior Publication Data

US 2008/0240802 A1 Oct. 2, 2008

(30) Foreign Application Priority Data

Mar. 29, 2007 (JP) ..... 2007-086363
Mar. 29, 2007 (JP) ..... 2007-086467

(51) Int. Cl.
*G03G 15/01* (2006.01)

(52) U.S. Cl. ..... 399/302; 399/303; 399/308; 399/312

(58) Field of Classification Search ..... 399/302, 399/303, 308, 311, 312
See application file for complete search history.

(56) References Cited

U.S. PATENT DOCUMENTS

| | | | | |
|---|---|---|---|---|
| 5,347,348 | A | 9/1994 | Nagata et al. | |
| 6,321,052 | B1 * | 11/2001 | Yamashina et al. | 399/165 |
| 6,934,497 | B2 | 8/2005 | Hagiwara et al. | |
| 2004/0126151 | A1 * | 7/2004 | Asuwa et al. | 399/302 |
| 2006/0289280 | A1 | 12/2006 | Furuya et al. | |

FOREIGN PATENT DOCUMENTS

| | | |
|---|---|---|
| JP | 05-341673 | 12/1993 |
| JP | 11-227930 | 8/1999 |
| JP | 2000-098762 | 4/2000 |
| JP | 2001-083840 | 3/2001 |
| JP | 2001-134047 | 5/2001 |
| JP | 2002-148882 | 5/2002 |
| JP | 2003-337454 | 11/2003 |
| JP | 2006-018182 | 1/2006 |
| JP | 2006-343629 | 12/2006 |

OTHER PUBLICATIONS

Machine translation of JP 2006-343629.*
European Search Report.
Office Action for corresponding Japanese patent application No. 2007-086467 mailed Jan. 19, 2012.
English translation of Office Action for corresponding Japanese patent application No. 2007-086363 mailed Oct. 18, 2011 (and original Office Action in Japanese).
Office Action for corresponding Japanese patent application No. 2011-274187 mailed on Aug. 10, 2012.

* cited by examiner

*Primary Examiner* — Walter L Lindsay, Jr.
*Assistant Examiner* — Roy Y Yi
(74) *Attorney, Agent, or Firm* — Harness, Dickey & Pierce, P.L.C.

(57) ABSTRACT

A belt device includes a belt member, a detecting unit, and a preventing member. The belt member is stretched over a plurality of rollers and moves in a predetermined moving direction. The detecting unit detects deviation of the belt member in a belt width direction of the belt member. The preventing member is arranged near the detecting unit and prevents deviation of the belt member in a direction other than the moving direction and the belt width direction.

54 Claims, 4 Drawing Sheets

BELT DEVICE, BELT DEVIATION DETECTING DEVICE, AND IMAGE FORMING APPARATUS

CROSS-REFERENCE TO RELATED APPLICATIONS

The present application claims priority to and incorporates by reference the entire contents of Japanese priority documents, 2007-086363 filed in Japan on Mar. 29, 2007 and 2007-086467 filed in Japan on Mar. 29, 2007.

BACKGROUND OF THE INVENTION

1. Field of the Invention

The present invention relates to a belt device, a belt deviation detecting device, and an image forming apparatus.

2. Description of the Related Art

Among image forming apparatuses such as copiers and printers is known a tandem color image forming apparatus including an intermediate transfer belt (belt member) as disclosed in, for example, Japanese Patent Application Laid-open Nos. 2006-343629 and 2001-83840.

A tandem color image forming apparatus includes an intermediate transfer belt and four photosensitive drums (image carriers) that are opposed to the intermediate transfer belt. Black (K), yellow (Y), magenta (M), and cyan (C) toner images are formed on the photosensitive drums, respectively. The K, Y, M, and C toner images are transferred onto the intermediate transfer belt in a superimposed manner to obtain a superimposed toner image. The superimposed toner image on the intermediate transfer belt is then transferred as a color image onto a recording medium.

For example, Japanese Patent Application Laid-open Nos. 2006-343629 and 2001-83840 disclose conventional technologies related to such an image forming apparatus for detecting deviation of a belt member in a direction of a width of the belt member (hereinafter, "belt width direction") and correcting the deviation based on a result of the detection. The conventional technologies are made to reduce inconveniences that, for example, the belt member is twisted or deviates in the belt width direction to the extent that it comes in contact with a different unit and thus is damaged.

Specifically, the conventional image forming apparatus disclosed in Japanese Patent Application Laid-open No. 2006-343629 includes a sensor that detects an amount of swaying of a swaying member that is in contact with an edge portion of an intermediate transfer belt (endless belt) as a belt member and that sways along with deviation of the intermediate transfer belt. Based on a result of the detection, a correcting unit (deviation correcting roller) corrects the deviation (twist) of the intermediate transfer belt.

The above conventional image forming apparatus cannot accurately detect deviation of the belt member in the belt width direction when the belt member deviates in a direction perpendicular to the belt width direction that is not a direction in which the belt member rotates (moves) (hereinafter, "belt rotation direction"). In other words, in addition to a deviation component in the belt width direction that is supposed to be detected, the detecting unit sometimes detects a deviation component in a direction other than the belt width direction and the belt rotation direction. This decreases the accuracy in correcting the deviation of the belt member based on the result of the detection by the detecting unit.

The belt member deviates in the direction other than the belt width direction and the belt rotation direction because the belt member supported by and stretched over a plurality of rollers moves while waving in the direction perpendicular to the belt width direction. Such waving of the belt member frequently occurs particularly in a high-speed image forming apparatus in which a belt member moves at high speed (i.e., an image forming apparatus having a high process linear speed).

The belt member is not limited to an intermediate transfer belt and can be a transfer-conveyer belt or a photosensitive belt deviation of which is detected and corrected.

In addition, in the conventional image forming apparatus, the deviation of the belt member in the belt width direction may not be detected with high accuracy.

Specifically, the belt member of the conventional image forming apparatus is in contact with the swaying member with a large area. Thus, when the belt member deviates (twists) in the direction perpendicular to the belt width direction (not the belt rotation direction but the vertical direction), the swaying member may sway along with the deviation in the vertical direction, which may results in inaccurate detection of the deviation of the belt member in the belt width direction. Moreover, variation in accuracy in attaching the swaying member to the belt member (an angle at which the swaying member is attached to the belt member) tends to cause variation in the result of detecting the deviation of the belt member in the belt width direction. Furthermore, the swaying member and the belt member are frayed or worn after moving for a long period while in contact with each other. This leads to a chronological change in the result of detection of the deviation of the belt member in the belt width direction.

The above inconveniences cannot be ignored especially in a high-speed image forming apparatus.

SUMMARY OF THE INVENTION

It is an object of the present invention to at least partially solve the problems in the conventional technology.

According to an aspect of the present invention, there is provided a belt device including a belt member that is stretched over a plurality of rollers and moves in a predetermined moving direction; a detecting unit that detects deviation of the belt member in a belt width direction of the belt member; and a preventing member that is arranged near the detecting unit, and that prevents deviation of the belt member in a direction other than the moving direction and the belt width direction.

According to another aspect of the present invention, there is provided a belt deviation detecting device that detects deviation of a belt member in a belt width direction of the belt member, which moves in a predetermined direction. The belt deviation detecting device includes a swaying member that sways along with the deviation of the belt member in the belt width direction, and includes a contact portion that is in contact with an edge of the belt member in the belt width direction; and a detecting unit that detects an amount of swaying of the swaying member. The contact portion has a curved surface.

According to still another aspect of the present invention, there is provided an image forming apparatus including a belt device that includes a belt member that is stretched over a plurality of rollers and moves in a predetermined moving direction; a detecting unit that detects deviation of the belt member in a belt width direction of the belt member; and a preventing member that is arranged near the detecting unit, and that prevents deviation of the belt member in a direction other than the moving direction and the belt width direction.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
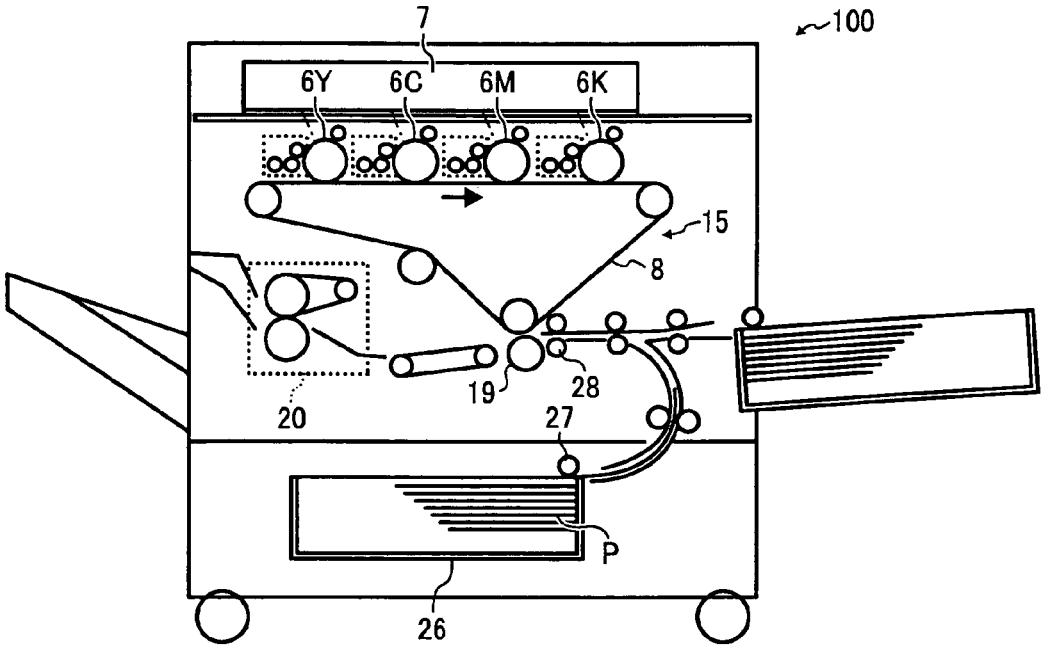
FIG. 1 is a schematic diagram of an image forming apparatus according a first embodiment of the present invention.

Exemplary embodiments of the present invention are explained in detail below with reference to the accompanying drawings. Like reference characters refer to corresponding portions throughout the drawings.

FIG. 1 is a schematic diagram of a printer 100 as an image forming apparatus according to an embodiment of the present invention. The printer 100 includes an intermediate transfer belt device 15 arranged in the center of the printer 100. The printer 100 further includes image forming units 6Y, 6M, 6C, and 6K that corresponds respectively to colors of yellow (Y), magenta (M), cyan (C), and black (K). The image forming units 6Y, 6M, 6C, and 6K are arrange in parallel and opposed to an intermediate transfer belt 8 of the intermediate transfer belt device 15.

The image forming units 6Y, 6M, 6C, and 6K are of basically the same configuration except that they form an image with toner of different colors, and thus but one of them, for example, the image forming unit 6Y is explained below.

Figure 2:
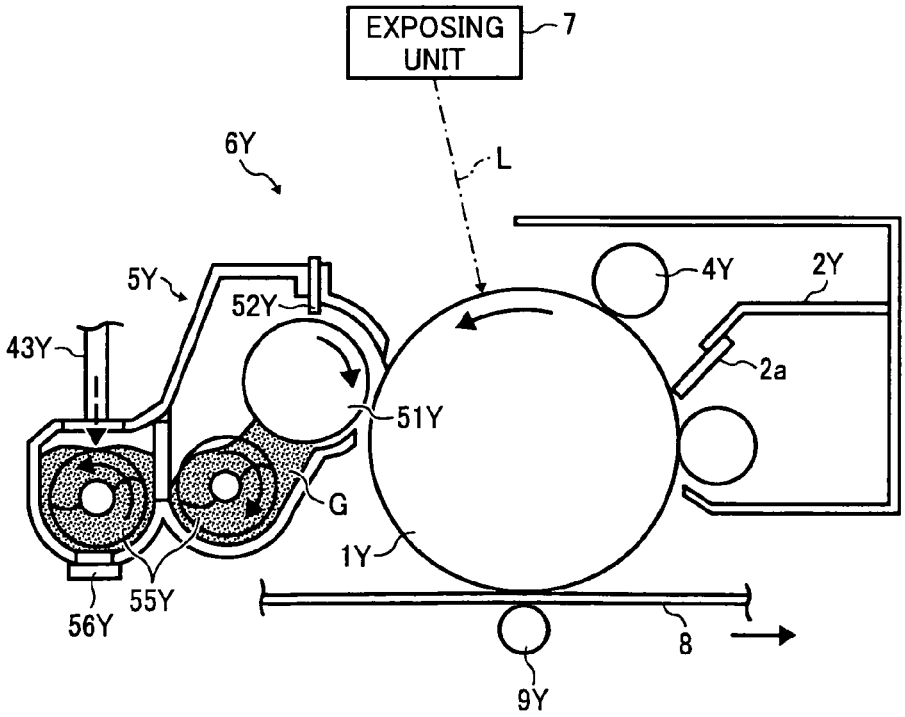
FIG. 2 is a schematic diagram of an image forming unit shown in FIG. 1.

FIG. 2 is a schematic diagram of the image forming unit 6Y. The image forming unit 6Y includes a photosensitive drum 1Y, and further includes a charging unit 4Y, a developing unit 5Y, a cleaning unit 2Y, and a neutralizing unit (not shown) that are arranged around the photosensitive drum 1Y. An image forming process including a charging step, an exposing step, a developing step, and a transferring step is performed on the photosensitive drum 1Y to form a Y-image on a surface thereof.

The photosensitive drum 1Y is rotated by a drive motor (not shown) clockwise as indicated by an arrow shown in FIG. 2. The surface of the photosensitive drum 1Y is uniformly charged by the charging unit 4Y (charging step).

The photosensitive drum 1Y rotates such that its surface is irradiated with a laser light L emitted by an exposing unit 7 based on image data. The laser light L forms a Y-electrostatic latent image on the surface of the photosensitive drum 1Y (exposing step).

The Y-electrostatic latent image on the surface of the photosensitive drum 1Y is developed by the developing unit 5Y into a Y-toner image (developing step).

The photosensitive drum 1Y rotates such that the Y-toner image reaches a position where the intermediate transfer belt 8 faces a transfer roller 9Y, and the Y-toner image is transferred onto the intermediate transfer belt 8 (a primary transfer step). At this stage, toner resides on the surface of the photosensitive drum 1Y (hereinafter, "residual toner").

The residual toner is removed from the surface of the photosensitive drum 1Y by a cleaning blade 2*a* of the cleaning unit 2Y and collected in the cleaning unit 2Y (cleaning step).

Thereafter, the neutralizing unit neutralizes residual electric potential on the surface of the photosensitive drum 1Y. Thus, the image forming process is completed.

The image forming process is performed by the image forming units 6M, 6C, and 6K in the same manner as above. Specifically, the laser light L emitted from the exposing unit 7 is deflected by a rotating polygon mirror to the photosensitive drums 1M, 1C, and 1K via a plurality of optical elements. Thus, the photosensitive drums 1M, 1C, and 1K are exposed with the laser light L and M, C, and K-electrostatic latent images are formed thereon, respectively. The Y, M, C, and K toner images formed on the photosensitive drums 1Y, 1M, 1C, and 1K by the developing step are transferred onto the intermediate transfer belt 8 in a superimposed manner, so that a superimposed color image is formed on the intermediate transfer belt 8.

Figure 3:
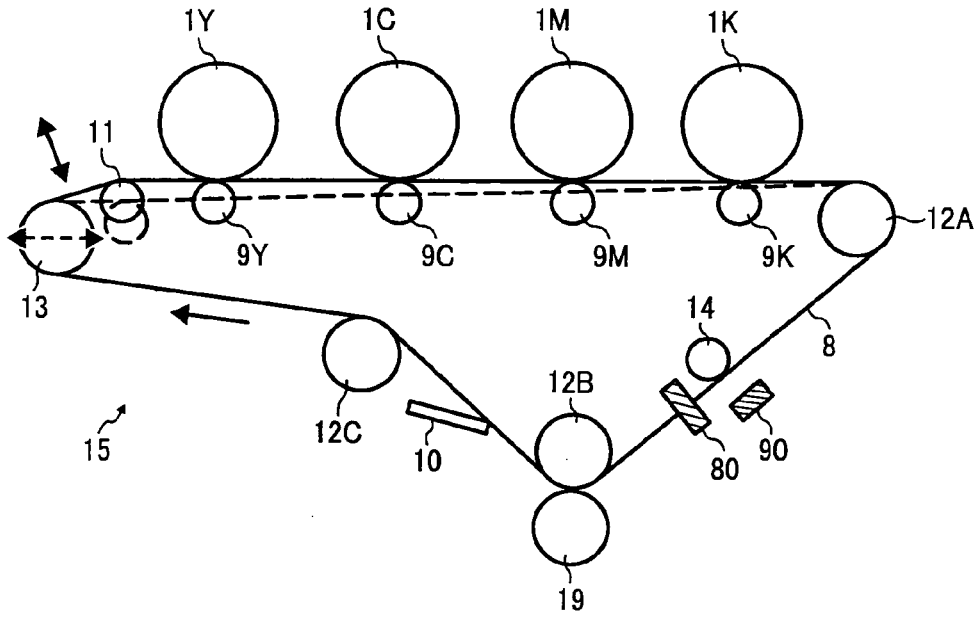
FIG. 3 is a schematic diagram of a belt device shown in FIG. 1.

As shown in FIG. 3, the intermediate transfer belt device 15 includes the intermediate transfer belt 8, transfer rollers 9Y, 9M, 9C and 9K, a drive roller 12A, support rollers 12B and 12C, a correcting roller 13, a movable roller 11, a roller member 14, a detecting unit 80, a photosensor 90, and a cleaning unit 10. The intermediate transfer belt 8 is supported by and stretched over the movable roller 11, the drive roller 12A, the support rollers 12B and 12C, and the correcting roller 13. Because of the rotation of a roller (the drive roller 12A), the intermediate transfer belt 8 rotates (endlessly moves) in the direction indicated by an arrow shown in FIG. 3.

The transfer rollers 9Y, 9M, 9C, and 9K and the photosensitive drums 1Y, 1M, 1C, and 1K form primary transfer nips between which is interposed the intermediate transfer belt 8. A voltage (i.e., a transfer bias) having a polarity opposite to that of the toner is applied to the transfer rollers 9Y, 9M, 9C, and 9K.

The intermediate transfer belt 8 passes through the primary transfer nips, so that the Y, M, C, and K-toner images on the photosensitive drums 1Y, 1M, 1C, and 1K are sequentially transferred onto the intermediate transfer belt 8 in a superimposed manner (primary transfer step).

Thereafter, the intermediate transfer belt 8 rotates such that the surface having a superimposed toner image of the Y, M, C, and K-toner images faces a secondary transfer roller 19. At this position, the support roller 12B and the secondary transfer roller 19 form a secondary transfer nip between which is interposed the intermediate transfer belt 8. The superimposed toner image is transferred onto a sheet (recording medium) P that is conveyed to the secondary transfer nip (secondary transfer step). At this stage, the surface of the intermediate transfer belt 8 has residual toner.

Thereafter, the cleaning unit 10 removes the residual toner from the surface of the intermediate transfer belt 8.

In this manner, a transfer process performed on the intermediate transfer belt 8 is completed. A configuration and operations of the intermediate transfer belt device 15 are explained in detail below with reference to FIGS. 3 to 5.

The sheet P is fed from a sheet cassette 26, which is positioned in a lower portion of the printer 100 as shown in FIG. 1 (or on a side-wall side), and conveyed to the second transfer nip via, for example, a sheet feeding roller 27 and a pair of registration rollers 28.

Specifically, a stack of the sheets P are stored in the sheet cassette 26. When the sheet feeding roller 27 is rotated counterclockwise, the top sheet P is fed from the sheet cassette 26 to the registration rollers 28.

The sheet P temporarily stops at a roller nip between the registration rollers 28 having stopped rotating. The registration rollers 28 restart rotating at a specific timing to convey the sheet P to the secondary transfer nip. The superimposed toner image on the intermediate transfer belt 8 is transferred onto the sheet P at the secondary transfer nip, so that a desired color image is formed on the sheet P.

Thereafter, the sheet P is conveyed to a fixing unit 20, and the color image is fixed onto the sheet P by heat and pressure by a fixing roller and a pressurizing roller of the fixing unit 20.

Thereafter, the sheet P is discharged as an output image by a pair of discharging rollers (not shown) to the outside of the printer 100 on a stacker on which the sheets P are sequentially stacked. Thus, the image forming process is completed.

A configuration and operations of the developing unit 5Y are explained in detail below with reference to FIG. 2.

The developing unit 5Y includes a developing roller 51Y opposed to the photosensitive drum 1Y, a doctor blade 52Y, two transfer screws 55Y in a developer container, a toner supplying path 43Y that communicates with the developer container, and a toner concentration sensor 56Y that detects concentration of toner in a developer (hereinafter, "toner concentration"). The developing roller 51Y includes a magnet and a sleeve that surrounds the magnet. The developer container is partitioned into two compartments, and contains a developer containing toner and carrier.

The sleeve of the developing roller 51Y rotates in a direction indicated by an arrow shown in FIG. 2. The developer is lifted up to the developing roller 51Y by a magnetic force of the magnet of the developing roller 51Y, and moves on the developing roller 51Y along with the rotation of the sleeve. The ratio of toner in the developer, i.e., toner concentration, is adjusted to be within a predetermined range.

The developer is circulated in the developer container while being mixed and stirred by the transfer screws 55Y. The toner in the developer adheres to the carrier because of triboelectric charging between the toner and the carrier, and the toner adheres to the developing roller 51Y together with the carrier by the magnetic force generated on the surface of the developing roller 51Y.

The developer on the surface of the developing roller 51Y is conveyed in a direction indicated by an arrow shown in FIG. 2 to the doctor blade 52Y, and the doctor blade 52Y adjusts the amount of the developer on the surface of the developing roller 51Y. Thereafter, the developer is conveyed to a position opposed to the photosensitive drum 1Y (hereinafter, "developing area"). Because of a magnetic field formed in the developing area, the toner adheres to the electrostatic latent image on the photosensitive drum 1Y. The developer residing on the developing roller 51Y reaches an upper space of the developer container along with the rotation of the sleeve and separates from the developing roller 51Y.

The intermediate transfer belt device 15 is explained in detail with reference to FIGS. 3 to 5.

FIG. 3 is a schematic diagram of the intermediate transfer belt device 15. FIG. 4 is a top view of part of the intermediate transfer belt device 15. FIG. 5 is a perspective view of part of the intermediate transfer belt device 15.

Figure 4:
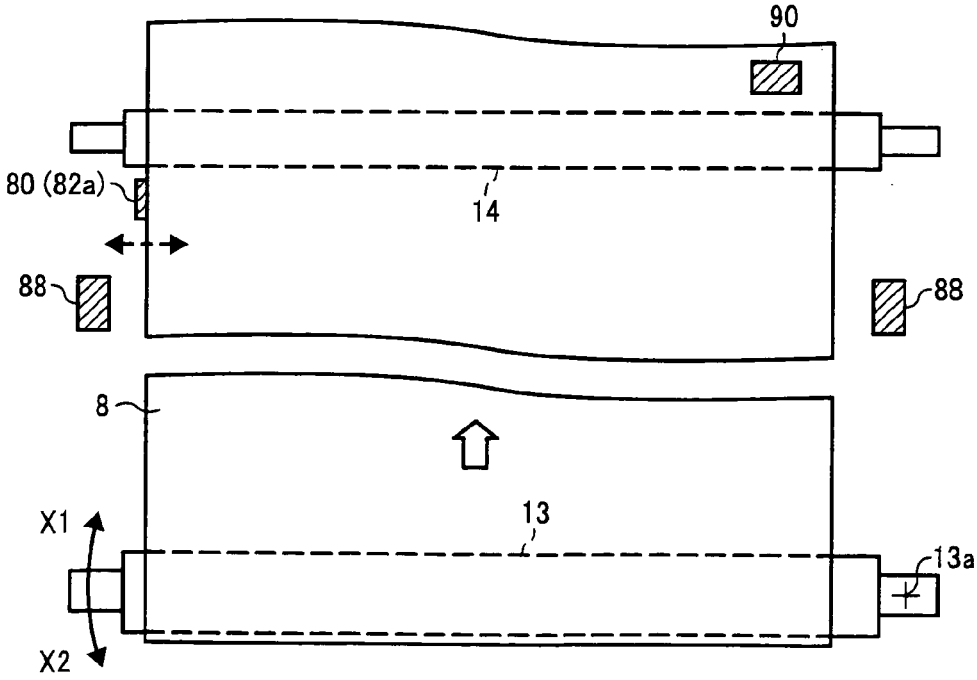
FIG. 4 is a top view of an example of part of a belt member of the belt device.

As shown in FIG. 4, the intermediate transfer belt device 15 further includes an error sensor 88. The intermediate transfer belt 8 is opposed to the photosensitive drums 1Y, 1M, 1C, and 1K.

The intermediate transfer belt 8 of the first embodiment is formed of a layer or a plurality of layers made of polyvinylidene difluoride (PVDF), ethylen-tetrafluorethylen-copolymer (ETFE), polyimide (PI), or polycarbonate (PC), in which a conductive material such as carbon black is dispersed. A volume resistivity of the intermediate transfer belt 8 is adjusted to be within a range from $10^7$ Ocm to $10^{12}$ Ocm and the surface resistivity of the back surface of the intermediate transfer belt 8 is adjusted to be within a range from $10^8$ Ocm to $10^{12}$ Ocm. The thickness of the intermediate transfer belt 8 is within a range from 80 micrometers to 100 micrometers. Specifically, in the first embodiment, the intermediate transfer belt 8 has a thickness of 90 micrometers.

The surface of the intermediate transfer belt 8 can be coated with a release layer. Examples of material of the release layer include, but are not limited to, fluororesin such as ETFE, polytetrafluoroethylene (PTFE), PVDF, fluorinated ethylene propylene (PVDF), polyfluoroalkoxy (PFA), tetrafluoroethylene-co-hexafluoropropylene (FEP), or polyvinyl fluoride (PVF).

The intermediate transfer belt 8 is manufactured by, for example, casting or a centrifugal method. The surface of the intermediate transfer belt 8 is polished if necessary.

The transfer rollers 9Y, 9M, 9C, and 9K are opposed to the photosensitive drums 1Y, 1M, 1C, and 1K with the intermediate transfer belt 8 interposed therebetween.

Specifically, the transfer roller 9Y is opposed to the photosensitive drum 1Y with the intermediate transfer belt 8 interposed therebetween, the transfer roller 9M is opposed to the photosensitive drum 1M with the intermediate transfer belt 8 interposed therebetween, the transfer roller 9C is opposed to the photosensitive drum 1C with the intermediate transfer belt 8 interposed therebetween, and the transfer roller 9K is opposed to the photosensitive drum 1K with the intermediate transfer belt 8 interposed therebetween.

The movable roller 11 is supported by a support member (not shown) together with the transfer rollers 9Y, 9M, 9C, and 9K and is capable of separating the intermediate transfer belt 8 from the photosensitive drums 1Y, 1M, 1C, and 1K.

Specifically, when the movable roller 11 moves to a position indicated by a circle of a dotted line shown in FIG. 3, the transfer rollers 9Y, 9M. 9C, and 9K move lower as well. Thus, the intermediate transfer belt 8 separates from the photosensitive drums 1Y, 1M, 1C, and 1K as indicated by a dotted line shown in FIG. 3. While the image forming process is not performed, the intermediate transfer belt 8 is separated from the photosensitive drums 1Y, 1M, 1C, and 1K to reduce abrasion of the intermediate transfer belt 8.

The drive roller 12A is rotated by a drive motor (not shown) to rotate the intermediate transfer belt 8 in a predetermined direction (clockwise in FIG. 3).

The support roller 12B forms a nip with the secondary transfer roller 19 with the intermediate transfer belt 8 interposed therebetween. The support roller 12C is in contact with an outer circumference (front surface) of the intermediate transfer belt 8. The cleaning unit 10 (cleaning blade) is arranged between the support rollers 12B and 12C.

The detecting unit 80 detects deviation of the intermediate transfer belt 8 in a direction of the width of the intermediate transfer belt 8 (hereinafter, "belt width direction").

The detecting unit 80 is explained in detail below with reference to FIG. 5. The detecting unit 80 includes a swaying member 82 that is in contact with an edge of the intermediate transfer belt 8 in the belt width direction, a distance sensor 81 that detects the amount of swaying of the swaying member 82, and a spring 83 that biases the swaying member 82 toward the intermediate transfer belt 8.

The swaying member 82 includes a first arm member 82*a*, a rotation shaft 82*b*, and a second arm member 82*c*. A first end portion of the first arm member 82*a* is in contact with the edge of the intermediate transfer belt 8, and a second end portion of the first arm member 82*a*, which is on an side opposite to that of the first end portion, is fixed to the rotation shaft 82*b*. The rotation shaft 82*b* is rotatably supported by a chassis (not shown) of the intermediate transfer belt device 15. A first end portion of the second arm member 82*c* is fixed to the rotation shaft 82*b*. A first end of the spring 83 is fixed to a center portion of the second arm member 82*c*. A second end of the spring 83 is connected to the chassis.

Figure 5:
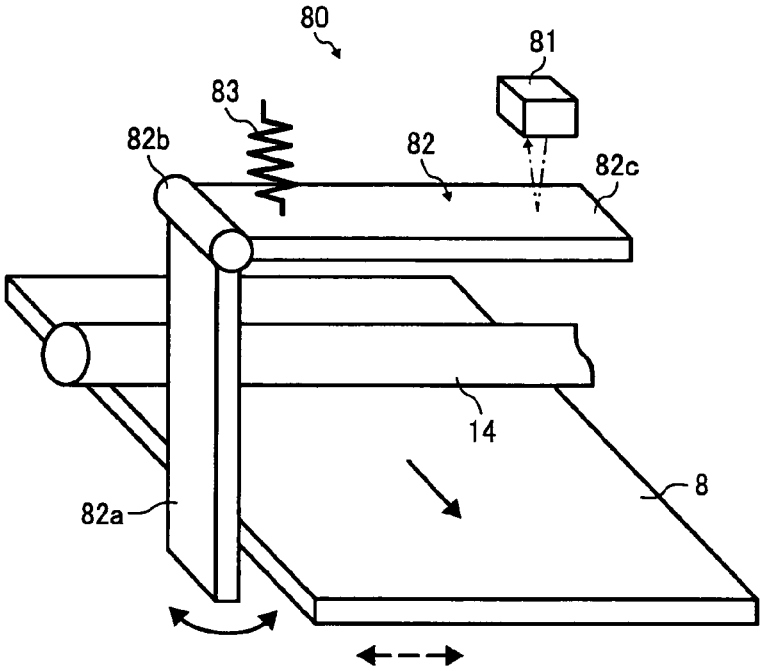
FIG. 5 is a perspective view of a detecting unit shown in FIG. 3.

The swaying member 82 sways with the deviation of the intermediate transfer belt 8 in the belt width direction indicated by a dotted arrow shown in FIG. 5. The intermediate transfer belt 8 rotates, for example, at a speed of 400 mm/sec in a direction indicated by an arrow shown in FIG. 5 (hereinafter, "belt rotation direction")

The distance sensor 81 is fixed to the chassis above a second end portion of the second arm member 82*c*, which is on a side opposite to that of the first end portion of the second arm member 82*c*. The distance sensor 81 includes a position sensitive detector (PSD) and a plurality of light emitting elements (infrared-emitting diodes) arranged horizontally in parallel with a specific spacing. An infrared light emitted from the light emitting element is reflected on a surface of the second arm unit 82*c* and is incident on the PSD as a reflected light. A position where the reflected light is incident on the PSD (hereinafter, "incident position") changes depending on a distance between the distance sensor 81 and the surface of the second arm member 82*c*. The value of an output of the distance sensor 81 changes in proportion to the change in the incident position. Because of this, the deviation of the intermediate transfer belt 8 in the belt width direction can be detected. Specifically, when the distance detected by the distance sensor 81 is smaller than a predetermined value, the intermediate transfer belt 8 deviates to a right side shown in FIG. 5 in the belt width direction from a target position where the intermediate transfer belt 8 is supposed to be positioned. On the other hand, when the distance detected by the distance sensor 81 is larger than a predetermined value, the intermediate transfer belt 8 deviates to a left side in the belt width direction from the target position.

The roller member 14 is arranged near the detecting unit 80. The roller member 14 prevents the deviation of the intermediate transfer belt 8 in a direction other than the belt width direction and the belt rotation direction. Specifically, the roller member 14 is arranged in a position on an upstream side in the belt rotation direction of the position where the swaying member 82 (the first arm member 82*a*) and the intermediate transfer belt 8 are in contact with each other.

The above structure reduces the deviation of the intermediate transfer belt 8 in the direction perpendicular to the belt width direction at the detecting unit 80 (i.e., at the position where the swaying member 82 and the intermediate transfer belt 8 are in contact with each other. In other words, the roller member 14 increase the tensile force of the intermediate transfer belt 8, which prevents the deviation of the of the intermediate transfer belt 8 in the direction perpendicular to the belt width direction at the detecting unit 80. This reduces a possibility that the detecting unit 80 detects a deviation component in a direction other than the belt width direction and the belt rotation direction in addition to a deviation component in the belt width direction. Thus, accuracy increases in the detection of the deviation of the intermediate transfer belt 8 by the detecting unit 80.

In the first embodiment, the roller member 14 that rotates along with the rotation of the intermediate transfer belt 8 is used to prevent the deviation of the intermediate transfer belt 8 in the direction perpendicular to the belt width direction. Thus, damage to the inner circumference (back surface) of the intermediate transfer belt 8 can be reduced with a relatively simple configuration.

When the detecting unit 80 detects the deviation of the intermediate transfer belt 8 in the belt width direction, based on a result of the detection, the correcting roller 13 corrects the deviation of the intermediate transfer belt 8.

As shown in FIG. 3, the correcting roller 13 is positioned on an upstream side of the photosensitive drums 1Y, 1M, 1C, and 1K in the belt rotation direction and is in contact with the back surface of the intermediate transfer belt 8. The correcting roller 13 is configured to move in directions indicated by arrows X1 and X2 shown in FIG. 4 (hereinafter, "X1 direction" and "X2 direction") when a drive cam (not shown) moves by a predetermined angle.

When the detecting unit 80 detects the deviation of the intermediate transfer belt 8 to the right side, the correcting roller 13 moves in the X2 direction based on the detection by the detecting unit 80 to correct the deviation. In this manner, the intermediate transfer belt 8 is prevented from rotating while twisted or from deviating to the extent that it is in contact with another member and thus is damaged.

The detecting unit 80 and the roller member 14 are distant from the correcting roller 13. Specifically, while the correcting roller 13 is positioned on the upstream side of the photosensitive drums 1Y, 1M, 1C, and 1K in the belt rotation direction, the detecting unit 80 and the roller member 14 are positioned on a downstream side of the photosensitive drums 1Y, 1M, 1C, and 1K in the belt rotation direction.

With this arrangement, accuracy of the detection by the detecting unit 80 increases because the prevention of the deviation of the intermediate transfer belt 8 by the roller member 14 does not decrease even if the correcting roller 13 moves to correct the deviation of the intermediate transfer belt 8.

The error sensors 88 are arranged on both sides of the intermediate transfer belt 8 in the belt width direction, and are about 5 millimeters distant from the edges of the intermediate transfer belt 8 in the belt width direction.

An error sensor 88 includes an arm member that is in contact with the intermediate transfer belt 8 when the intermediate transfer belt 8 largely deviates, an optical sensor that optically detects movement of the arm member on a rotation axis, which is caused because the intermediate transfer belt 8 is in contact with the arm member.

The error sensor 88 is configured to detect an error, i.e., the deviation of the intermediate transfer belt 8 which cannot be corrected by the correcting roller 13. When the error sensor 88 detects an error, the driving of the intermediate transfer belt 8 by the drive roller 12A is terminated, and a display unit of the printer 100 displays an error message such as those notifying a user that fixation by a service engineer is required.

The detecting unit 80 and the roller member 14 are distant from an area where the intermediate transfer belt 8 is opposed to the photosensitive drums 1Y, 1M, 1C, and 1K. Specifically, the detecting unit 80 and the roller member 14 are positioned on a downstream side in the belt rotation direction of the area where the intermediate transfer belt 8 is opposed to the photosensitive drums 1Y, 1M, 1C, and 1K.

Thus, compared with a case where the detecting unit 80 and the roller member 14 are arranged at the area where the intermediate transfer belt 8 is opposed to the photosensitive drums 1Y, 1M, 1C, and 1K, the intermediate transfer belt device 15 can be downsized and the mechanism for separating the intermediate transfer belt 8 from the photosensitive drums 1Y, 1M, 1C, and 1K can be simplified. Moreover, efficiency of maintenance of the detecting unit 80 improves and an erroneous operation of the detecting unit 80, which is caused by noise due to a high-voltage power source (not shown) provided near the image forming units 6Y, 6M, 6C, and 6K, can be prevented.

In the first embodiment, the photosensor 90 is positioned near the roller member 14. The photosensor 90 detects the position and toner concentration of the toner image (patch pattern) on the intermediate transfer belt 8 to optimize the environment in which an image is formed. Specifically, the photosensor 90 optically detects the shifting of the toner image formed on the intermediate transfer belt 8 via the image forming process explained above. Based on the result of the detection of the shifting of the toner image, the timing of exposing the photosensitive drums 1Y, 1M, 1C, and 1K by the exposing unit 7 is adjusted. In addition, the photosensor 90 detects the toner concentration of the toner image on the intermediate transfer belt 8. Based on the result of the detection of the toner concentration, the toner concentration of the developer stored in the developing unit 5Y is adjusted.

Arranging the photosensor 90 near the roller member 14 reduces a possibility that the photosensor 90 detects the intermediate transfer belt 8 with the surface waving. Because the distance between the photosensor 90 and the toner image is kept stable, the photosensor 90 can detect the position and toner concentration of the toner image with high accuracy.

According to the first embodiment, because the roller member 14 is arranged near the detecting unit 80, the deviation of the intermediate transfer belt 8 in the belt width direction can be accurately detected with a simple configuration even if the image forming performs high speed printing.

In the first embodiment, the roller member 14 that is in contact with the back surface of the intermediate transfer belt 8 is used as the preventing unit. Alternatively, a pair of roller members that are respectively in contact with the front and back surfaces of the intermediate transfer belt 8 can be arranged as the preventing unit. Also with such roller members, deviation of the intermediate transfer belt 8 in the direction perpendicular to the belt width direction can be prevented near the detecting unit 80. Thus, the same effects as those obtained with the roller member 14 can be achieved.

In the first embodiment, the intermediate transfer belt device 15 including the intermediate transfer belt 8 is used as a belt device. Alternatively, a belt device including a transfer-conveying belt can be used. In the belt device, while a recording medium is conveyed on the transfer-conveying belt, a plurality of toner images is directly transferred onto the recording medium, so that a color image is formed on the recording medium. Furthermore, a belt device including a photosensitive endless belt that has same functions as those of the photosensitive drums 1Y, 1M, 1C, and 1K of the first embodiment can be alternatively used. Also in this case, by arranging, near a detecting unit, a preventing unit that prevents deviation of a belt member in a direction perpendicular to a belt width direction of the belt member, the same effects as those obtained in the first embodiment can be achieved.

An intermediate transfer belt device according to a second embodiment of the present invention is explained below with reference to FIGS. 6 to 8. The intermediate transfer belt device of the second embodiment includes a detecting unit 180 that detects deviation of the intermediate transfer belt 8 in the belt width direction.

Figure 7:
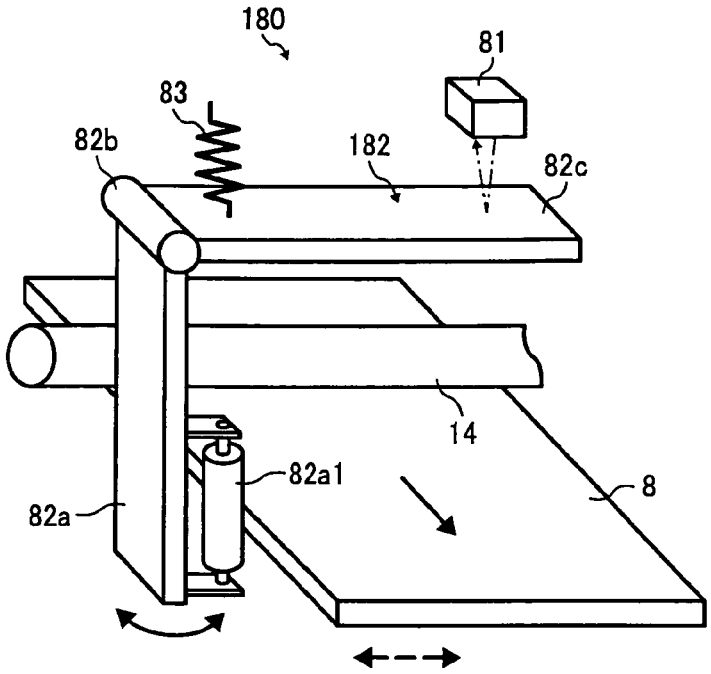
FIG. 7 is a perspective view of a detecting unit according to a second embodiment of the present invention.
Figure 8:
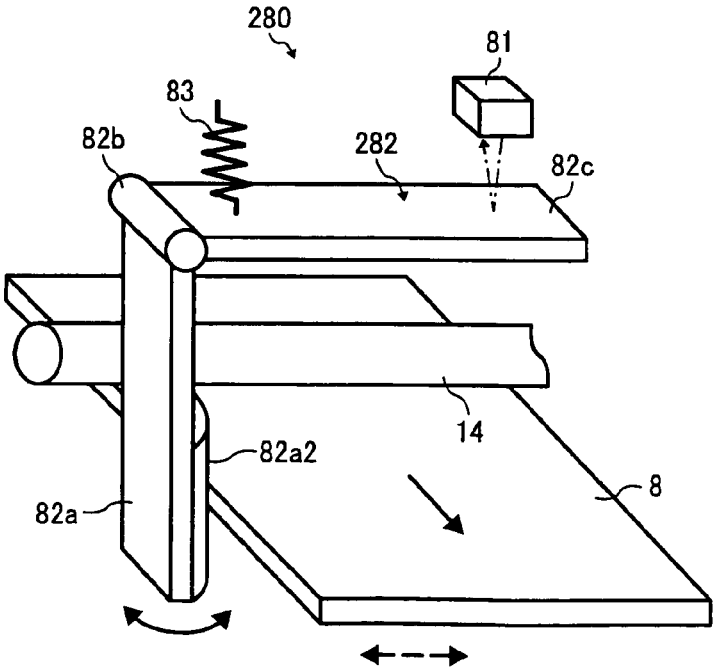
FIG. 8 is a perspective view of a modification of the detecting unit shown in FIG. 7.

As shown in FIG. 7, the detecting unit 180 includes a swaying member 182 that is in contact with the edge of the intermediate transfer belt 8 in the belt width direction, the distance sensor 81 that detects the amount of swaying of the swaying member 182, and the spring 83 that biases the swaying member 182 to the intermediate transfer belt 8.

The swaying member 182 includes the first arm member 82*a*, the rotation shaft 82*b*, and the second arm member 82*c*.

The swaying member 182 further includes a cylindrical member 82*a*1 that is provided to the first arm member 82*a*, and that is in contact with the edge of the intermediate transfer belt 8. The second end portion of the first arm member 82*a* is fixed to the rotation shaft 82*b*. The rotation shaft 82*b* is rotatably supported by the chassis (not shown) of the intermediate transfer belt device. The first end portion of the second arm member 82*c* is fixed to the rotation shaft 82*b*. The first end of the spring 83 is fixed to the center portion of the second arm member 82*c*. The second end of the spring 83 is connected to the chassis.

The swaying member 182 sways with the deviation of the intermediate transfer belt 8 in the belt width direction indicated by an arrow of a dotted line shown in FIG. 7.

The distance sensor 81 is fixed to the chassis above a second end portion of the second arm member 82*c*. The distance sensor 81 includes the PSD and the light emitting elements (infrared-emitting diodes) arranged in parallel with a specific interval. An infrared light emitted from the light emitting element is reflected on the surface of the second arm unit 82*c* and is incident on the PSD as a reflected light. A position where the reflected light is incident on the PSD (hereinafter, "incident position") changes depending on a distance between the distance sensor 81 and the surface of the second arm member 82*c*. The value of an output of the distance sensor 81 changes in proportion to the incident position. Based on the distance between the distance sensor 81 and the second arm member 82*c*, the deviation of the intermediate transfer belt 8 in the belt width direction can be detected. Specifically, when the distance detected by the distance sensor 81 is smaller than a predetermined value, the intermediate transfer belt 8 deviates to a right side shown in FIG. 5 in the belt width direction from a target position where the intermediate transfer belt 8 should be positioned. On the other hand, when the distance detected by the distance sensor 81 is larger than a predetermined value, the intermediate transfer belt 8 deviates to a left side from the target position in the belt width direction.

The intermediate transfer belt 8 of the second embodiment rotates at a speed of 400 mm/sec in a direction indicated by an arrow shown in FIG. 7 (hereinafter, "belt rotation direction").

A biasing force of the spring 83 is such that the intermediate transfer belt 8 does not deform due to the swaying member 182 being in contact with the intermediate transfer belt 8 (hereinafter, "contact force") while the swaying member 182 is pressed against the intermediate transfer belt 8 without vibrating even with the deviation (chattering) of the intermediate transfer belt 8 in the belt width direction. Specifically, the contact force of a contact portion (the cylindrical member 82*a*1) of the swaying member 182 is about 70 grams in the second embodiment. In the second embodiment, the cylindrical member 82*a*1 having a curved surface serves as the contact portion.

Because the cylindrical member 82*a*1 has the curved surface, the swaying member 182 has linear contact (or point contact from a macroscopic point of view) with the intermediate transfer belt 8 (i.e., the cylindrical member 82*a*1 is in contact with the intermediate transfer belt 8 in a small area). Thus, even if the intermediate transfer belt 8 deviates in the direction perpendicular to the belt width direction, the swaying member 182 tends not to sway due to the deviation of the intermediate transfer belt 8. Moreover, even if accuracy in attaching the swaying member 182 to the intermediate transfer belt 8 (an angle at which the swaying member 182 is attached to the intermediate transfer belt 8) varies, the result of detecting the deviation of the intermediate transfer belt 8 in the belt width direction by the distance sensor 81 tends not to vary. Furthermore, the abrasion of the swaying member 182 (the cylindrical member 82*a*1) and the intermediate transfer belt 8, which is caused because the swaying member 182 and the intermediate transfer belt 8 move while being in contact with each other, is reduced. Thus, it is possible to detect the deviation of the intermediate transfer belt 8 in the belt width direction with high accuracy over time.

Because the cylindrical member 82*a*1 is made of a metal material such as stainless in the second embodiment, the abrasion of the cylindrical member 82*a*1, which is caused because the cylindrical member 82*a*1 move while being in contact with each other, tends not to occur. Thus, chronological change in the result of the detection by the distance sensor 81 can be reduced. It is particularly preferable that the cylindrical member 82*a*1 has a smooth surface with a low coefficient of friction.

In the second embodiment, the cylindrical member 82*a*1 is rotated by the rotation of the intermediate transfer belt 8 in the direction indicated by an arrow shown in FIG. 7. This reduces the abrasion of the cylindrical member 82*a*1, and thus, the accuracy in the detection by the distance sensor 81 does not to decrease over time. A rotation shaft of the cylindrical member 82*a*1 is supported by the first arm member 82*a*. Thus, even while the cylindrical member 82*a*1 rotates, the swaying member does not sway as long as the intermediate transfer belt 8 does not deviate.

The roller member 14 is arranged near the detecting unit 180. The roller member 14 prevents the deviation of the intermediate transfer belt 8 in the direction other than the belt width direction and the belt rotation direction. Specifically, the roller member 14 is positioned near the contact portion (i.e., the cylindrical member 82*a*1) between the swaying member 182 (the first arm member 82*a*) and the intermediate transfer belt 8.

The above structure reduces the deviation of the intermediate transfer belt 8 in the direction perpendicular to the belt width direction at the detecting unit 180 (the cylindrical member 82*a*1). Specifically, the roller member 14 increases the tensile force of the intermediate transfer belt 8, which prevents the deviation of the intermediate transfer belt 8 in the direction perpendicular to the belt width direction at the detecting unit 180. This reduces a possibility that the detecting unit 180 detects a deviation component in a direction other than the belt width direction and the belt rotation direction in addition to a deviation component in the belt width direction. Thus, accuracy increases in the detection of the deviation of the intermediate transfer belt 8 by the detecting unit 180.

Based on a result of the detection of the deviation of the intermediate transfer belt 8 in the belt width direction by the detecting unit 80, the correcting roller 13 corrects the deviation of the intermediate transfer belt 8.

In the second embodiment, as in the case shown in FIG. 3, the correcting roller 13 is positioned on an upstream side of the photosensitive drums 1Y, 1M, 1C, and 1K in the belt rotation direction and is in contact with the back surface of the intermediate transfer belt 8. The correcting roller 13 is configured to move in directions indicated by arrows X1 and X2 shown in FIG. 6 (hereinafter, "X1 direction" and "X2 direction") on the moving axis 13*a* when the drive cam (not shown) moves by a predetermined angle.

When the detecting unit 180 detects the deviation of the intermediate transfer belt 8 to the right side, the correcting roller 13 moves in the X2 direction based on a result of the detection by the detecting unit 180, so that the deviation is corrected. In this manner, the intermediate transfer belt 8 is prevented from twisting or from deviating in the belt width direction to the extent that it is in contact with another member and thus is damaged.

In the second embodiment, the detecting unit 180 is distant from the correcting roller 13. Specifically, while the correcting roller 13 is positioned on an upstream side of an area where the intermediate transfer belt 8 is opposed to the photosensitive drums 1Y, 1M, 1C, and 1K (hereinafter, "opposition area") in the belt rotation direction, the detecting unit 80 is positioned on a downstream side of the opposition area in the belt rotation direction.

Because the detecting unit 180 is distant from the correcting roller 13 as explained above and effects of preventing the deviation of the intermediate transfer belt 8 by the roller member 14 does not decrease even when the correcting roller 13 moves the intermediate transfer belt 8 (corrects the deviation of the intermediate transfer belt 8 in the belt width direction of), the detecting unit 180 can detect the deviation in the belt width direction with high accuracy.

The error sensors 88 are arranged on both sides of the intermediate transfer belt 8 in the belt width direction, and are about 5 millimeters distant from the edges of the intermediate transfer belt 8 in the belt width direction.

The error sensor 88 includes the arm member that is in contact with the intermediate transfer belt 8 when the intermediate transfer belt 8 largely deviates, the optical sensor that optically detects rotation (movement) of the arm member on its rotation shaft, which is caused because the intermediate transfer belt 8 is in contact with the arm member.

The error sensor 88 detects the deviation of the intermediate transfer belt 8, which cannot be corrected by the correcting roller 13 (i.e., the error sensor 88 detects an error). When the error sensor 88 detects an error, the driving of the intermediate transfer belt 8 by the drive roller 12A is terminated, and a message prompting fixing is displayed on a display unit of the printer 100.

In the second embodiment, the detecting unit 180 is distant from the opposition area as explained above. Specifically, the detecting unit 180 and the roller member 14 are positioned on the downstream side of the opposition area in the belt rotation direction (where a primary transfer step is performed).

Thus, compared with a case where the detecting unit 180 is arranged at the opposition area, the intermediate transfer belt device 15 can be downsized and the system for separating the intermediate transfer belt 8 from the photosensitive drums 1Y, 1M, 1C, and 1K can be simplified. Moreover, efficiency of maintenance of the detecting unit 180 improves and an erroneous operation of the detecting unit 180, which is caused by noise due to the high-voltage power source (not shown) provided near the image forming units 6Y, 6M, 6C, and 6K, can be prevented.

Figure 6:
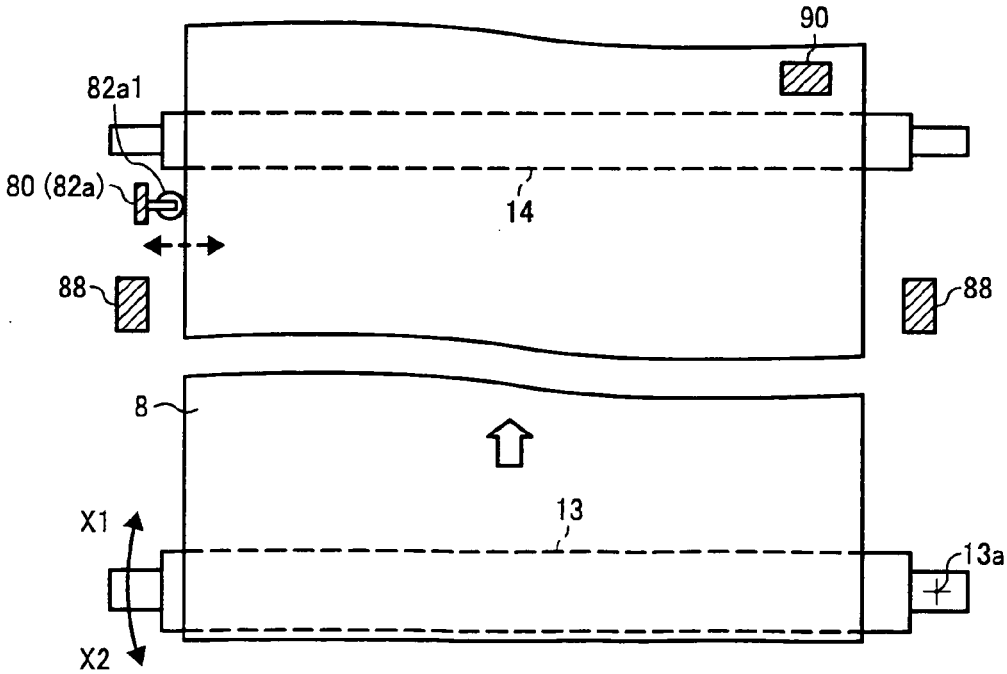
FIG. 6 is a top view of another example of part of a belt member of the belt device.

In the second embodiment, the photosensor 90 is positioned near the roller member 14 as shown in FIGS. 3 and 6. The photosensor 90 detects the position and toner concentration of a toner image (patch pattern) on the intermediate transfer belt 8 to optimize the environment in which an image is formed. Specifically, the photosensor 90 optically detects the shifting of the toner image formed on the intermediate transfer belt 8 via the image forming process explained above. Based on the result of the detection of the shifting of the toner image, the timing of exposing the photosensitive drums 1Y, 1M, 1C, and 1K by the exposing unit 7 is adjusted. In addition, the photosensor 90 optically detects the toner concentration of the toner image on the intermediate transfer belt 8. Based on the result of the detection of the toner concentration, the toner concentration of the developer stored in the developing unit 5 is adjusted.

Arranging the photosensor 90 near the roller member 14 reduces a possibility that the photosensor 90 detects the deviation of the intermediate transfer belt 8 with the waving surface. Because the distance between the photosensor 90 and the toner image is kept constant, the photosensor 90 can detect the position and toner concentration of the toner image with high accuracy.

In the second embodiment, because the contact portion (cylindrical member 82*a*1) of the swaying member 182 that is in contact with the edge of the intermediate transfer belt 8 has the curved surface, the swaying member 182 has the linear contact with the intermediate transfer belt 8 (i.e., the swaying member 182 is in contact with the intermediate transfer belt 8 in a small area). Thus, even if high speed printing is performed, the deviation of the intermediate transfer belt 8 in the belt width direction can be detected with high accuracy over time with a relatively simple configuration.

A modification of the detecting unit 180 of the second embodiment is explained below as a detecting unit 280 with reference to FIG. 8. FIG. 8 is a perspective view of the detecting unit 280.

The detecting unit 280 includes a swaying member 282, the distance sensor 81, and the spring 83. The swaying member 282 includes a curved member 82*a*2 that has a curved surface and that is integrally formed with the first arm member 82*a*. The curved member 82*a*2 serves as a contact portion that is in contact with the edge of the intermediate transfer belt 8 in the belt width direction.

Because of the curved member 82*a*2, the swaying member 282 has linear contact (or point contact from a macroscopic point of view) with the intermediate transfer belt 8 (i.e., the curved member 82*a*2 is in contact with the intermediate transfer belt 8 in a small area). Thus, as in the case of the first and second embodiments, deviation of the intermediate transfer belt 8 in the belt width direction can be detected with high accuracy.

In the modification, it is preferable that the curved member 82*a*2 be formed of a metal material and have a smooth surface with a low coefficient of friction. The metal material and the smooth surface improve durability of the swaying member 282 and reduce the possibility that the accuracy in the detection by the distance sensor 81 gradually decreases over time.

As explained above, because the contact portion (the curved member 82*a*2) of the swaying member 282 has the curved surface, the swaying member 282 has linear contact with the intermediate transfer belt 8 (i.e., the curved member 82*a*2 is in contact with the intermediate transfer belt in a small area). Thus, even if high speed printing is performed, the deviation of the intermediate transfer belt 8 in the belt width direction can be detected with high accuracy over time with a relatively simple configuration.

In the first and second embodiments and the modification, an intermediate transfer belt is cited as an example of a belt member deviation of which is detected. Alternatively, the belt member can be a transfer-conveying belt that conveys a recording medium onto which are transferred toner images of different colors to form a color image thereon. The belt member can also be a photosensitive endless belt that has the same function as the photosensitive drums 1Y, 1M, 1C, and 1K described in the first embodiment. In these cases also, by providing a contact portion of a swaying member with a curved surface that is in contact with the belt member, the same effects as those obtained in the above embodiments can be achieved.

According to an aspect of the present invention, deviation of a belt member in the belt width direction can be detected with high accuracy over a period of time with a simple configuration.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A belt device comprising:

a belt member that is stretched over a plurality of rollers including a first roller, a second roller and a third roller arranged from upstream to downstream in this order and moves in a predetermined moving direction;

a plurality of image carriers in contact with the belt member, each image carrier carrying respectively each toner image for each color;

a secondary transfer roller provided at a position opposing the third roller such that the belt member is nipped therebetween forming a secondary transfer nip so that a toner image formed on the belt member is transferred onto a recording sheet that is conveyed to a position of the secondary transfer nip;

a movable roller that detaches the belt member from the plurality of image carriers;

a detecting unit that detects deviation of the belt member in a belt width direction of the belt member; and a preventing member that is arranged near to the detecting unit, and that prevents deviation of the belt member in a direction other than the moving direction and the belt width direction, wherein the first roller corrects deviation of the belt member in the width direction based on a result detected by the detecting unit;

the plurality of image carriers and the movable roller are provided downstream of the first roller in the belt conveying direction and upstream of the second roller, and are provided to contact the belt member; and the detecting unit and the preventing member are provided at a position downstream of the second roller in the belt conveying direction and upstream of the third roller in the belt conveying direction.

2. The belt member according to claim 1, wherein the detecting unit includes a swaying member that is in contact with an edge of the belt member in the belt width direction, and that sways along with the deviation of the belt member in the belt width direction; and a sensor that detects an amount of swaying of the swaying member, and the preventing member is arranged proximal to a position where the swaying member is in contact with the belt member.

3. The belt device according to claim 1, further comprising a second detecting unit that detects at least one of a position of a toner image on the belt member and toner concentration of the toner image, and that is positioned near the preventing member.

4. The belt device according to claim 1, wherein the preventing member is a roller that is in contact with at least one of an inner circumference surface and an outer circumference surface of the belt member.

5. A belt deviation detecting device that detects deviation of a belt member in a belt width direction of the belt member, the belt member moving in a predetermined direction, the belt deviation detecting device comprising:

a swaying member that sways in the width direction along with the deviation of the belt member in the belt width direction, the swaying member including a contact portion that is in contact with a side edge of the belt member in the belt width direction; and a detecting unit that detects an amount of swaying of the swaying member, wherein the contact portion has a curved surface and the contact portion is cylindrical and rotates along with movement of the belt member.

6. The belt deviation detecting device according to claim 5, wherein the detecting unit is a distance sensor.

7. The belt device according to claim 1, further comprising:

a secondary transfer member arranged in a position opposed to the intermediate transfer belt, wherein a secondary transfer nip is formed between the secondary transfer member and the intermediate transfer belt such that the toner images formed on the intermediate transfer belt are transferred to a recording medium via the secondary transfer nip; and a fixing unit that fixes the toner images which are transferred on the recording medium via the secondary transfer nip, wherein the detecting unit and the preventing member are arranged in the counter side to the fixing unit, interposing the secondary transfer nip.

8. The belt deviation detecting device according to claim 1, wherein the preventing member is arranged upstream of the detecting unit.

9. The belt deviation detecting device according to claim 2, wherein the preventing member is located adjacent to a point of contact between the swaying member and the belt member.

10. The belt deviation detecting device according to claim 5, wherein the contact portion contacts a vertical edge of the belt member in the width direction.

11. The belt deviation detecting device according to claim 1, wherein the second roller is a driving roller that drives the belt member.

12. A belt device comprising:

a belt member that moves in a predetermined direction, wherein a toner image is transferred from an image carrier onto a front surface of the belt member or a recording medium conveyed on the front surface of the belt member; and a detecting unit that detects deviation of the belt member in a belt width direction, wherein the detecting unit includes:

a swaying member that sways along with the deviation of the belt member in the belt width direction, the swaying member including a contact portion that is in contact with a side edge of the belt member in the belt width direction, and a detecting portion that detects deviation of the swaying member, the belt member is made of a resin material, and the contact portion is a cylindrical member made of a metal material.

13. The belt device according to claim 12, wherein the belt member is formed of a layer or a plurality of layers made of at least one of materials selected from polyvinylidene difluoride (PVDF), ethylene-tetrafluorethylene-copolymer (ETFE), polyimide (PI), and polycarbonate (PC).

14. The belt device according to claim 12, wherein the front surface of the belt member is coated with a release layer.

15. The belt device according to claim 12, wherein the thickness of the belt member is from 80 micrometers to 100 micrometers.

16. The belt device according to claim 12, wherein the contact portion is made of stainless.

17. The belt device according to claim 12, wherein the contact portion rotates along with movement of the belt member.

18. The belt device according to claim 12, wherein the detecting unit further includes a rotation shaft that rotatably supports the cylindrical member, the rotation shaft extending over the belt member from the front surface to a back surface.

19. The belt device according to claim 18, wherein the detecting unit further includes a pair of support members that supports the rotation shaft from both a front-surface side and a back-surface side of the belt member, the swaying member includes an arm member that extends over the belt member from the front surface to the back surface, and one support member is supported by the arm member at a front-surface-side position and other support member is supported by the arm member a back-surface-side position.

20. The belt device according to claim 19, wherein the arm member is opposed to the side edge of the belt member in the belt width direction in such a manner that the rotation shaft Is between the arm member and the side edge.

21. The belt device according to claim 18, wherein the length of the cylindrical member in a shaft direction is longer than the thickness of the belt member.

22. The belt device according to claim 12, wherein the detecting portion is an optical sensor that detects an amount of deviation of the swaying member.

23. The belt device according to claim 22, wherein the optical sensor includes a light emitting element that emits light and a light receiving element that receives the light emitted from the light emitting element and then detects the light.

24. An image forming apparatus comprising the belt device according to claim 12, wherein the image carrier is of a plurality of image carriers aligned in a direction in which the belt member moves in such a manner that the image carriers are opposed to the front surface of the belt member.

25. The image forming apparatus according to claim 24, wherein the belt member is an intermediate transfer belt that is stretched over at least a driving roller, a movable roller, a first roller, and a second roller so that toner images are transferred from the image carriers onto the front surface of the belt member when the belt member moves in the predetermined direction, a toner image is transferred from the intermediate transfer belt onto a recording medium between a secondary transfer member, which is opposed to the first roller, and the first roller, the movable roller is configured to move the intermediate transfer belt away from some image carrier with the intermediate transfer belt being in contact with other image carrier, the detecting unit is arranged in a first area where the intermediate transfer belt is stretched over between the driving roller and the first roller, and the movable roller is arranged in a second area where the intermediate transfer belt is stretched over outside of the first area.

26. The image forming apparatus according to claim 25, wherein the image carriers are above the intermediate transfer belt, and the second transfer member is below the intermediate transfer belt.

27. The image forming apparatus comprising the belt device according to claim 24, wherein the belt member is an intermediate transfer belt that is stretched over at least a driving roller, a first roller, and a second roller so that toner images are transferred from the image carriers onto the front surface of the belt member when the belt member moves in the predetermined direction, a toner image is transferred from the intermediate transfer belt onto a recording medium between a secondary transfer member, which is opposed to the first roller, and the first roller, the detecting unit is arranged in a first area where the intermediate transfer belt is stretched over between the driving roller and the first roller, and the second roller is arranged in a second area where the intermediate transfer belt is stretched over outside of the first area.

28. The image forming apparatus according to claim 27, wherein the image carriers are above the intermediate transfer belt, and the second transfer member is below the intermediate transfer belt.

29. The image forming apparatus comprising the belt device according to claim 24, wherein the belt member is an intermediate transfer belt that is stretched over at least a driving roller, a correcting roller, a first roller, and a second roller so that toner images are transferred from the image carriers onto the front surface of the belt member when the belt member moves in the predetermined direction, a toner image is transferred from the intermediate transfer belt onto a recording medium between a secondary transfer member, which is opposed to the first roller, and the first roller, the correcting roller is configured to correct the deviation of the intermediate transfer belt in the belt width direction by swaying, based on a result of detection by the detecting unit, one end of the correcting roller in a roller width direction of the correcting roller about other end of the correcting roller, the detecting unit is arranged in a first area where the intermediate transfer belt is stretched over between the driving roller and the first roller, and the correcting roller is arranged in a second area where the intermediate transfer belt is stretched over outside of the first area.

30. The image forming apparatus according to claim 29, wherein the image carriers are above the intermediate transfer belt, and the second transfer member is below the Intermediate transfer belt.

31. A belt device comprising:

a belt member that moves in a predetermined direction, wherein a toner image is transferred from an image carrier onto a front surface of the belt member or a recording medium conveyed on the front surface of the belt member; and a detecting unit that detects deviation of the belt member in a belt width direction, wherein the detecting unit includes:

a swaying member that sways along with the deviation of the belt member in the belt width direction, the swaying member including a contact portion that is in contact with a side edge of the belt member in the belt width direction, and a detecting portion that detects deviation of the swaying member, the front surface of the belt member is coated with a release layer, and the contact portion is a cylindrical member made of a metal material.

32. The belt device according to claim 31, wherein the release layer is made of any material selected from ethylene-tetrafluorethylene-copolymer (ETFE) polytetrafluoroethylene (PTFE), polyvinylidene difluoride (PVDF), fluorinated ethylene propylene (PVDF), polyfluoroalkoxy (PFA), tetrafluoroethylene-co-hexafluoropropylene (FEP), and polyvinyl fluoride (PVF).

33. A belt device comprising:

a belt member that moves in a predetermined direction, wherein a toner image is transferred from an image carrier onto a front surface of the belt member or a recording medium conveyed on the front surface of the belt member; and a detecting unit that detects deviation of the belt member in a belt width direction, wherein the detecting unit includes:

a contact portion that is in contact with a side edge of the belt member in the belt width direction, a cross section of the contact portion being circular, a rotation shaft that extends over the belt member from the front surface to a back surface, the rotation shaft supporting the contact portion rotatably, a detection target member that supports both ends of the rotation shaft in a shaft direction and moves in the belt width direction together with the contact portion along with the deviation of the belt member in the belt width direction, wherein the detection target member is opposed to the side edge of the belt member in the belt width direction in such a manner that the rotation shaft is between the detection target member and the side edge, and a detecting portion that detects deviation of the detection target member.

34. The belt device according to claim 33, wherein the detecting portion is an optical sensor that detects an amount of deviation of the detection target member.

35. The belt device according to claim 34, wherein the optical sensor includes a light emitting element that emits light and a light receiving element that receives the light emitted from the light emitting element and then detects the light.

36. The belt device according to claim 33, the wherein the length of the cylindrical member in a shaft direction is longer than the thickness of the belt.

37. The belt device according to claim 33, wherein the cylindrical member rotates about the rotation shaft along with movement of the belt member.

38. The belt device according to claim 33, wherein the thickness of the belt member is from 80 micrometers to 100 micrometers.

39. An image forming apparatus comprising the belt device according to claim 33, wherein the image carrier is of a plurality of image carriers aligned in a direction in which the belt member moves in such a manner that the image carriers are opposed to the front surface of the belt member.

40. The image forming apparatus according to claim 39, wherein the belt member is an intermediate transfer belt that is stretched over at least a driving roller, a movable roller, a first roller, and a second roller so that toner images are transferred from the image carriers onto the front surface of the belt member when the belt member moves in the predetermined direction, a toner image is transferred from the intermediate transfer belt onto a recording medium between a secondary transfer member, which is opposed to the first roller, and the first roller, the movable roller is configured to move the intermediate transfer belt away from some image carrier with the intermediate transfer belt being in contact with other image carriers, the detecting unit is arranged in a first area where the intermediate transfer belt is stretched over between the driving roller and the first roller, and the movable roller is arranged in a second area where the intermediate transfer belt is stretched over outside of the first area.

41. The image forming apparatus according to claim 40, wherein the image carriers are above the intermediate transfer belt, and the second transfer member is below the intermediate transfer belt.

42. The image forming apparatus comprising the belt device according to claim 39, wherein the belt member is an intermediate transfer belt that is stretched over at least a driving roller, a first roller, and a second roller so that toner images are transferred from the image carriers onto the front surface of the belt member when the belt member moves in the predetermined direction, a toner image is transferred from the intermediate transfer belt onto a recording medium between a secondary transfer member, which is opposed to the first roller, and the first roller, the detecting unit is arranged in a first area where the intermediate transfer belt is stretched over between the driving roller and the first roller, and the second roller is arranged in a second area where the intermediate transfer belt is stretched over outside of the first area.

43. The image forming apparatus according to claim 42, wherein the image carriers are above the intermediate transfer belt, and the second transfer member is below the intermediate transfer belt.

44. The image forming apparatus comprising the belt device according to claim 39, wherein the belt member is an intermediate transfer belt that is stretched over at least a driving roller, a correcting roller, a first roller, and a second roller so that toner images are transferred from the image carriers onto the front surface of the belt member when the belt member moves in the predetermined direction, a toner image is transferred from the intermediate transfer belt onto a recording medium between a secondary transfer member, which is opposed to the first roller, and the first roller, the correcting roller is configured to correct the deviation of the intermediate transfer belt in the belt width direction by swaying, based on a result of detection by the detecting unit, one end of the correcting roller in a roller width direction of the correcting roller about other end of the correcting roller, the detecting unit is arranged in a first area where the intermediate transfer belt is stretched over between the driving roller and the first roller, and the correcting roller is arranged in a second area where the intermediate transfer belt is stretched over outside of the first area.

45. The image forming apparatus according to claim 44, wherein the image carriers are above the intermediate transfer belt, and the second transfer member is below the intermediate transfer belt.

46. A belt device comprising:

a belt member that moves in a predetermined direction, wherein a toner image is transferred from an image carrier onto a front surface of the belt member or a recording medium conveyed on the front surface of the belt member; and a detecting unit that detects deviation of the belt member in a belt width direction, wherein the detecting unit includes:

a cylindrical member that is in contact with a side edge of the belt member in the belt width direction, a rotation shaft of the cylindrical member that extends over the belt member from the front surface to a back surface, an arm member that supports both ends of the rotation shaft in a shaft direction and sways along with the deviation of the belt member in the belt width direction, and a detecting portion that detects deviation of the arm member.

47. The belt device according to claim 46, wherein the arm member supports the rotation shaft at a front-surface-side position and at a back-surface-side position of the belt member with respect to a position at which the cylindrical member is in contact with the belt member.

48. The belt device according to claim 46, wherein the arm member supports the rotation shaft at a position facing the side edge of the belt member in the belt width direction in such a manner that the rotation shaft Is between the arm member and the side edge.

49. A belt member, comprising:

a belt member that moves in a predetermined direction, wherein a toner image is transferred from an image carrier onto a front surface of the belt member or a recording medium conveyed on the front surface of the belt member; and a detecting unit that detects deviation of the belt member in a belt width direction, wherein the detecting unit includes:

a swaying member that sways along with the deviation of the belt member in the belt width direction, the swaying member including a cylindrical member that is in contact with a side edge of the belt member in the belt width direction, a first rotation shaft of the cylindrical member that extends over the belt member from the front surface to a back surface, a pair of support members that supports both ends of the first rotation shaft, a first arm member that supports the support members, wherein the first arm member extends In a direction parallel to a shaft direction of the first rotation shaft, and a second arm member that sways in associated with the first arm member, and a detecting portion that detects deviation of the second arm member.

50. The belt device according to claim 49, wherein the first arm member supports the support members at a front-surface-side position and a back-surface-side position with respect to a position where the cylindrical member is in contact with the belt member.

51. The belt device according to claim 49, wherein the first arm member supports the support members at a position where the first arm member is opposed to the side edge of the belt member in the belt width direction in such a manner that the first rotation shaft is between the first arm member and the side edge.

52. The belt device according to claim 49 further comprising a second rotation shaft that rotatably supports the first arm member and the second arm member, wherein the second rotation shaft extends in a direction parallel to the predetermined direction in which the belt member moves.

53. The belt device according to claim 49 further comprising a spring that biases the swaying member toward the belt member.

54. The belt device according to claim 49, wherein the cylindrical member has a smooth surface with a low coefficient of friction.

* * * * *

UNITED STATES PATENT AND TRADEMARK OFFICE

CERTIFICATE OF CORRECTION

PATENT NO. : 8,391,759 B2
APPLICATION NO. : 12/076813
DATED : March 5, 2013
INVENTOR(S) : Makoto Nakura It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1043 days.

Signed and Sealed this
Thirtieth Day of December, 2014

Michelle K. Lee

Michelle K. Lee
*Deputy Director of the United States Patent and Trademark Office*